US009915049B2

(12) United States Patent
Collinsworth et al.

(10) Patent No.: US 9,915,049 B2
(45) **Date of Patent: *Mar. 13, 2018**

(54) COST-EFFICIENT ARMOR UNIT

(71) Applicant: The United States of America as Represented by The Secretary of The Army, Washington, DC (US)

(72) Inventors: Stephen R Collinsworth, Fairhope, AL (US); Jeffrey A Melby, Vicksburg, MS (US)

(73) Assignee: The United States of America as Represented by The Secretary of The Army, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/217,417

(22) Filed: Mar. 17, 2014

(65) Prior Publication Data

US 2016/0017556 A1 Jan. 21, 2016

Related U.S. Application Data

(60) Provisional application No. 61/802,015, filed on Mar. 15, 2013.

(51) Int. Cl.

| | |
|---|---|
| ***E02B 3/14*** | (2006.01) |
| ***E02B 3/12*** | (2006.01) |
| ***E02B 3/06*** | (2006.01) |

(52) U.S. Cl.

CPC ..... *E02B 3/129* (2013.01); *E02B 3/06* (2013.01); *E02B 3/14* (2013.01)

(58) Field of Classification Search

USPC ..... 405/15–17, 21, 25, 29, 30, 31, 33, 35; 52/604, 608, 609, 591.1, 591.2; 249/117

See application file for complete search history.

(56) References Cited

U.S. PATENT DOCUMENTS 8,132,985 B2 * 3/2012 Melby ..... E02B 3/129 405/15

* cited by examiner

*Primary Examiner* — Sean D Andrish
(74) *Attorney, Agent, or Firm* — Brian C. Jones

(57) ABSTRACT

Armor units for rubble mound structures including breakwaters, revetments, groins, jetties, and the like. Embodiments are appropriate for ocean, river, lake and reservoir structure armoring, to prevent erosion from damaging hydrodynamic forces resulting from waves and water currents, and the like. An embodiment includes a central rectangular section, three "half H-shaped" appendages, optionally, one end frusta, and a flat bottom with two extrusions, nominally smaller than other appendages and frusta. An embodiment is symmetric about two perpendicularly intersecting vertical planes extending through the centroid of the unit. The three half H-shaped members are connected to outer parts of a side defined as the top and the two longitudinal sides of the central section. The three half H-shaped members comprise four-sided frusta that taper from a base at the central rectangular section to four-sided distal ends. For select embodiments, the frusta are generally symmetric.

1 Claim, 9 Drawing Sheets

COST-EFFICIENT ARMOR UNIT

STATEMENT OF GOVERNMENT INTEREST

Under paragraph 1(a) of Executive Order 10096, the conditions under which this invention was made entitle the Government of the United states, as represented by the Secretary of the Army, to an undivided interest therein on any patent granted thereon by the United States.

RELATED PATENT

This application is related to U.S. Pat. No. 8,132,985 to Melby & Collinsworth, issued 13 Mar. 2012, and incorporated herein by reference in its entirety.

This and related patents are available for licensing to qualified licensees.

BACKGROUND

Breakwaters are generally shore-parallel structures that reduce the amount of wave energy reaching the protected area. They are similar to natural bars, reefs, or near shore islands and are designed to dissipate wave energy. For breakwaters protecting harbors, the breakwater acts as a barrier to wave energy and often to direct alongshore sediment transport away from the harbor. For shore protection, offshore breakwaters provide a reduction in wave energy in the lee of the structure slowing the littoral drift, producing sediment deposition and a shoreline bulge or "salient" feature in the sheltered area behind the breakwater. Some alongshore sediment transport may continue along the coast behind a near shore breakwater.

There are various types of breakwaters. These include:

Headland breakwaters, a series of breakwaters constructed in an "attached" fashion to the shoreline and angled in the direction of predominant wave approach such that the shoreline behind the features evolves into a natural "crenulate" or log spiral embayment.

Detached breakwaters that are constructed away from the shoreline, usually a slight distance offshore. They are detached from the shoreline, and are designed to promote beach deposition on their leeside.

Single breakwaters that may be attached or detached depending on what they are being designed to protect. A single detached breakwater may protect a small section of shoreline. A single attached breakwater, may be a long structure designed to shelter marinas or harbors from wave action.

System breakwaters refer to two or more detached, offshore breakwaters constructed along an extensive length of shoreline.

Rubble mound jetties are often referred to as breakwaters. They are oriented shore-perpendicular and usually built as a pair at a natural inlet, to provide extension of a navigation channel some distance from the natural shoreline. These structures redirect the sediment transport away from the navigation channel and constrain the tidal flow in the channel in order to make an efficient channel that requires little maintenance for navigation compared to a natural inlet.

Breakwaters are typically constructed in high wave energy environments using large armor stone, or pre-cast concrete units or blocks. In lower wave-energy environments, grout-filled fabric bags, gabions and other proprietary units have been utilized. Typical breakwater design is similar to that of a revetment, with a core or filter layer of smaller stone, overlain by the armoring layer of armor stone or pre-cast concrete units.

Armor units conventionally constructed of concrete are typically used to protect rubble mound structures in relatively high wave environments or where stone armor is not readily available. Rubble mound structures include breakwaters, revetments, jetties, caissons, groins and the like. Coastal rubble mounds are gravity structures. Conventional armor units are heavy in order to prevent displacement or rocking from waves and currents.

Armor units are typically displaced by one or both of two dominant modes of structure failure. The first is displacement of the armor which leads to exposure and erosion of filter layers and subsequently the core. The second is armor breakage. The breakwater or revetment capacity will be significantly reduced if either of these two failure modes occurs and progressive failure of the structure made much more likely. The under layer (filter layer) is sized so as to not move under undamaged armor and to prevent interior stone (e.g., small quarry-run stone) from escaping.

A wave is described by its height, length, and the nature of breaking. The wave height is the dominant forcing parameter considered in designing armor units. Other parameters include wave length, water depth, structure shape and height, armor layer porosity, degree of armor interlocking, inter-unit friction, and armor density relative to the water.

It is known that waves exert forces on armor units in all directions. Slender armor units usually require steel reinforcement while more stout armor shapes do not. Adequate steel (rebar) reinforcement increases material costs by roughly 100% over un-reinforced concrete. Both steel and polypropylene fiber reinforcement have been used to provide about 10-20% increase in flexural tensile strengths for large armor units. The cost increase for the fiber-reinforced concrete equates to an equivalent percent increase in strength.

The advantages and disadvantages of various existing concrete armor units are generally described in the above-referenced U.S. Pat. No. 8,132,985.

For most armor units, it is difficult to achieve adequate interlocking when placing underwater. This is particularly true when the visibility is low and there are background waves during construction. For pattern-placed armor, it is virtually impossible to place them correctly with no visibility or when background waves are present. This condition is quite common. Achieving interlocking and a smooth under layer when there is low visibility and background waves is extremely difficult and the uncertainty has led to cost overruns and even breakwater failures.

Relatively slender armor units, and hollow blocks like the shed and cob, require high-cost moulds and are challenging to cast. Metal mould cost depends on the number of plates and complexity of the bends. Some armor unit moulds require 75-100 plates. Cubes require the fewest plates but have all the concrete concentrated in one mass. This produces high heat of hydration and potential thermal cracking. Tall moulds used for large armor units and hollow blocks also have potential for significant strength variations throughout the armor unit because the aggregate settles, compaction is greater at the bottom of the mould, and water rises when the concrete is vibrated during casting. High water-to-cement ratios and over-vibration, which can occur in poorly supervised construction, results in degraded armor units. For example, aggregate can concentrate in the lower portion of the unit while the upper portion has an abnormally high water-to-cement ratio yielding weaker concrete. In addition, complex shapes have horizontal or shallow sloping surfaces where water can pool in the mould, further reducing strength. The result is that tall complex shapes depend greatly on the quality of construction processes and can yield less than optimum strength.

The application dictates the appropriate armor unit. For shallow, clear water with insignificant background wave conditions, and waves under eight meters in height, most of the previously discussed armor units can be constructed and placed without difficulty. In these cases, an engineer chooses the least expensive unit that provides the prescribed reliability. However, for low visibility, high background wave conditions, or waves of eight meters or greater, the disadvantages of inexpensive existing armor units mean that construction of a duality structure is going to be difficult and expensive and may even be filled with uncertainty. Further, long slopes in armored configurations provide more opportunity for down-slope settlement and potential armor breakage or displacement as the interlocking is lost. Although cube armor units are relatively easy to construct, they do not interlock so maintenance costs are much higher than other designs and cube armor requires far more concrete than many other designs.

There is thus a need for a durable interlocking armor unit capable of random placement resulting in a stable configuration that has strong individual units while being relatively straightforward to fabricate. Each unit should have slender appendages to provide improved stability and wave energy dissipation yet be strong enough to prevent failure of any single unit. The Limit should be suitable for repair of existing slopes. It should be relatively simple to fabricate and lend itself to ready stacking for storage and shipping, thus reducing overall cost, as well as to emplacement in conditions not conducive to emplacing existing units.

The Armor Unit disclosed and claimed in the above-referenced U.S. Pat. No. 8,132,985 solves many problems of pre-existing designs.

As discussed above and in greater detail in U.S. Pat. No. 8,132,985, the challenge of designing an appropriate structure with armor units while providing the best value for the cost is a continual challenge both for the designer and the construction and engineering concern placing the units and executing on the design.

The improved cost-efficient armor unit of the present invention quite surprisingly provides excellent hydraulic stability, structural stability, packing density and other performance criteria while reducing the cost of the armor units of U.S. Pat. No. 8,132,985, and represents a significant advance in the art.

Quite surprisingly, the present invention is based upon the unexpected discovery that when the design of the armor units of U.S. Pat. No. 8,132,985 lack one or both of the end frusta, cost can be dramatically reduced while still providing provides excellent hydraulic stability, structural stability, packing density and other performance criteria

DETAILED DESCRIPTION

Figure 2A:
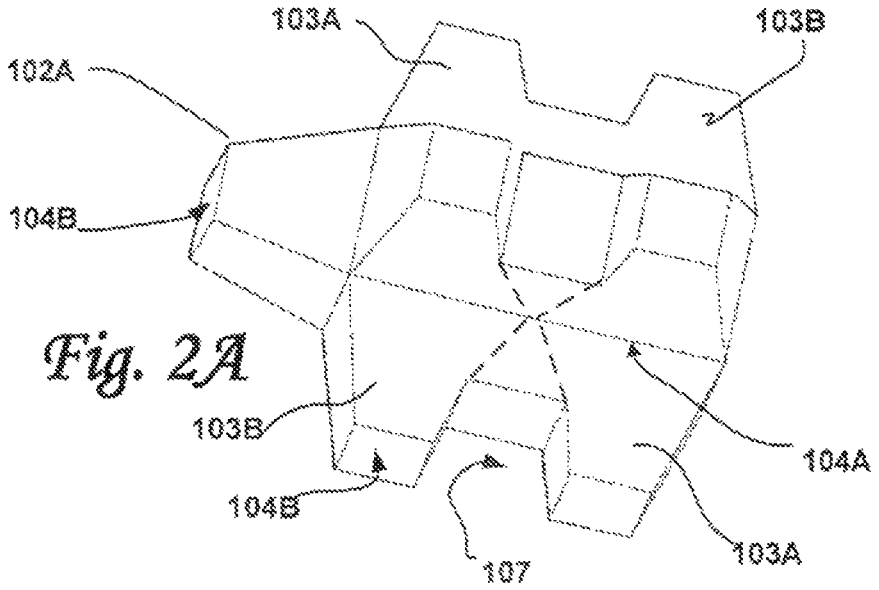
FIG. 2A is a perspective view from the top of a select embodiment of the present invention having only one end frusta.
Figure 2B:
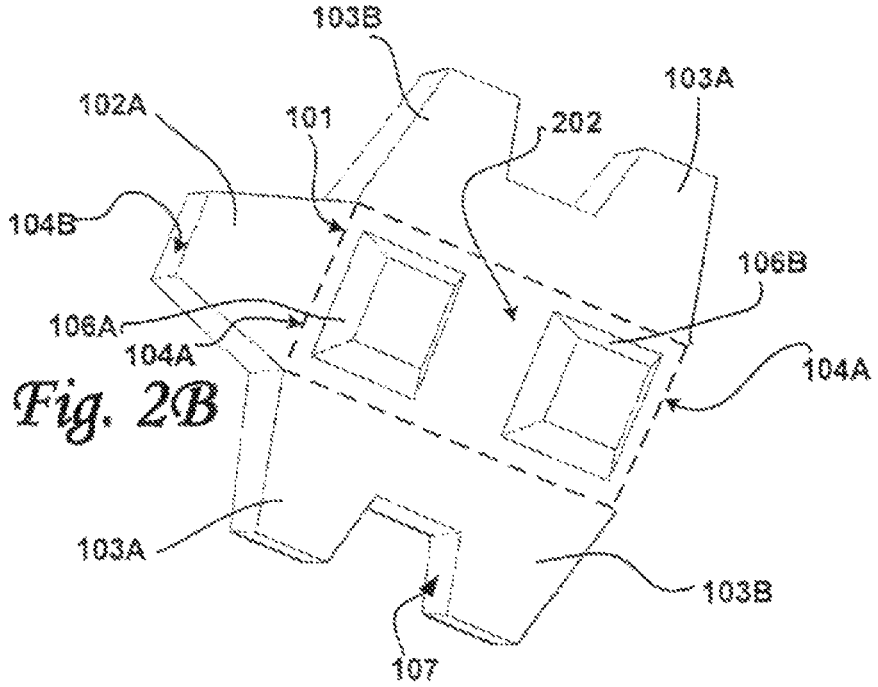
FIG. 2B is a perspective view from the bottom of a select embodiment of the present invention having only one end frusta.

Select embodiments of the present invention envision a concrete armor unit 100 for armoring alongshore structures of rivers, lakes, and reservoir banks; coastal shorelines and coastal revetments; and rubble mound breakwaters, jetties, caissons and groins to prevent erosion from damaging hydrodynamic forces of waves and water currents. The armor unit 100 may also have application to dam spillway and riverine baffle systems required to slow hydraulic flow. Select embodiments of the present invention provide an armor unit (erosion prevention module) 100 that is uniquely configured to produce a high degree of interlocking while providing stability on steep as well as relatively shallow slops on which it may be installed. Refer to FIG. 2A providing a perspective including a top surface of the central core (rectangle) 101 of a select embodiment of the present invention and FIG. 2B providing a perspective including a bottom surface 202 of the central core 101 of a select embodiment of the present invention, the bottom surface 202 parallel to the top surface.

In embodiments of the invention as shown in FIG. 1, FIG. 2A, FIG. 2B, FIG. 3, FIG. 4 and FIG. 5, the module 100 may have one end formation (frusta) 102A, which, if present, contributes to extending the central core 101 in the same plane as the central core 101 and along its longitudinal axis.

In other embodiments of the invention as shown in FIG. 6, FIG. 7A, FIG. 7B, FIG. 8 and FIG. 9, the module 100 has no one end formation (frusta).

The module 100 has a central core 101, said central core having a longitudinal axis, three identical side formations (frusta) 103A, B each pair 103 A, B joined by a fillet 105 of depth, t, the side formations 103A, B extending the central core 101 along the two axes perpendicular to its longitudinal axis, two of the side formations 103A, B opposing each other in the same plane as the central core 101 and one of the side formations 103A, B positioned on the top surface of the central core 101, and two identical symmetrically placed extrusions (frusta) 106 A, B that protrude from the bottom surface 202 of the central core 101, all formations 103A, B and extrusions 106A, B contributing to hydraulic stability and wave energy dissipation. Internal stress levels are minimized by adding the fillet 105 between each of the intersections of the two frusta 103A, B on each of the two long sides 2L and of the two frusta 103A, B on the top surface of select embodiments of the present invention and by providing extrusions ("supports" that are frusta) 106A, B symmetrically placed along the longitudinal axis on the bottom surface 202.

Figure 1:
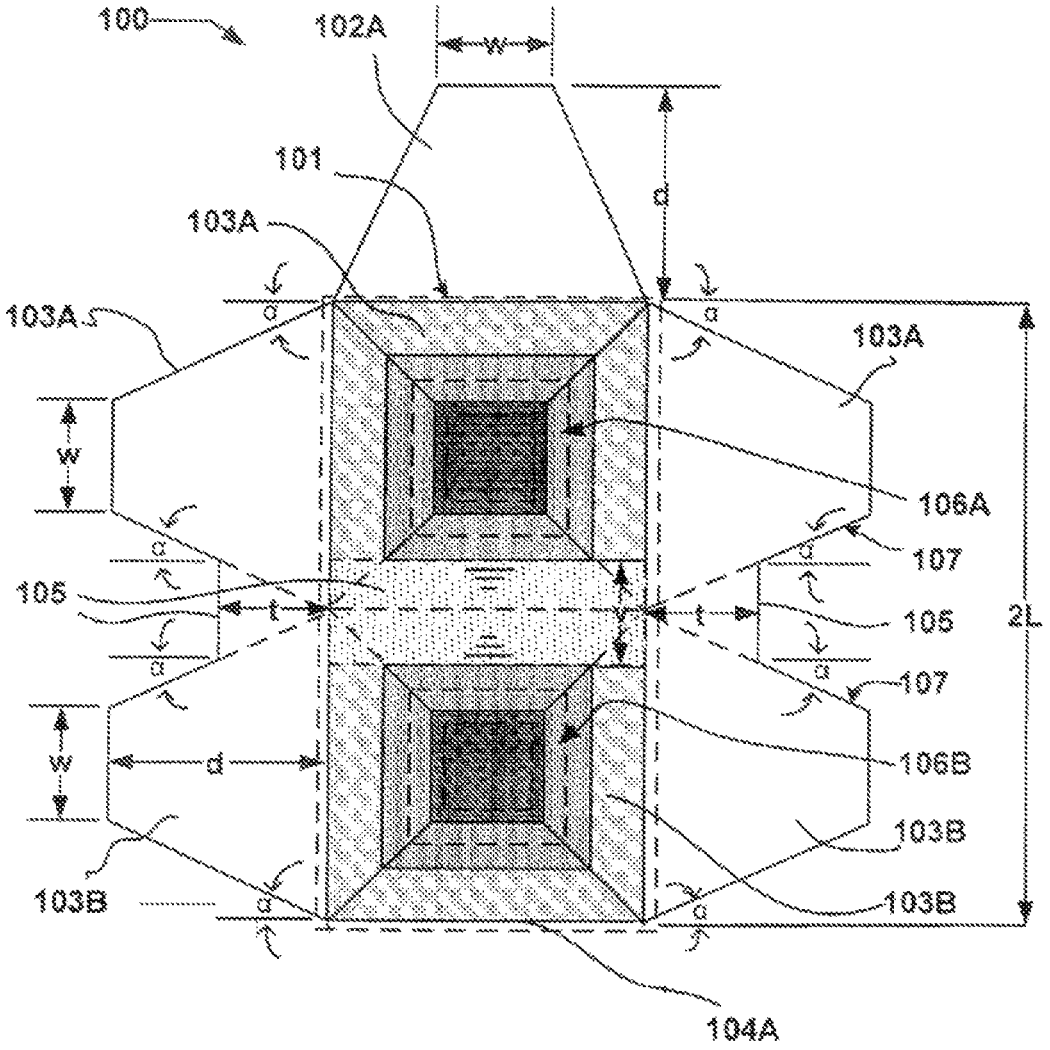
FIG. 1 is a top view of a select embodiment of the present invention having only one end frusta.

Refer to FIG. 1. Select embodiments of the present invention may comprise: a central rectangular core 101 as represented by the dotted hoes and of length, 2L, and width, L, with elongate axis centrally located as to all protrusions extending from the central core 101, optionally, one end formation 102A, which, if present contributes to extending the central core 101 longitudinally in the same plane as the central core 101.

If end formation 102A is present, the surfaces of the end formation 102A, except the end surfaces parallel to the narrow end of the central core established at an angle, α, measured from the sides of the central core 101 from which the formation 103A protrudes (shown in FIG. 4), and along three of the four long sides of length, 2L, of the central core 101, three identical side formations 103A, B each pair 103A, B joined by a fillet 105 of depth, t, the side formations 103A, B extending the central core 101 along the two axes perpendicular to its longitudinal axis, two of the side formations 103A, B opposing each other in the same plane as the central core 101 and one of the side formations positioned perpendicular to the top surface (FIG. 2) of the central core 101, each of the surfaces of the side formations 103A, B, except end surfaces parallel to the long ends, 2L, of the central core 101 established at an angle, α, measured from the sides of the central core 101 from which the side formations 103A, B protrude, and two identical symmetrically placed extrusions 106A, B that protrude from the bottom surface 202 (FIG. 2) of the central core 101, each of the surfaces of the extrusions 106A, B, except end surfaces parallel to the narrow ends, L, of the central core 101 established at an angle, α, measured from the bottom surface 202 of the central core 101 from which the extrusions 106A, B protrude, all formations 103A, B and extrusions 106A, B contributing to provide hydraulic stability and wave energy dissipation. Internal stress levels are minimized by adding the fillet 105 of depth, t, between each of the intersections of each of the two formations 103A, B on each of the two sides, 2L, and of the formations 103A, B on the top surface of select embodiments of the present invention. Each side formation (frustum) 103A, B and extrusion (frustum) 106A, B has a rectangular cross-section at its proximal base 104A and a smaller rectangular cross-section at its distal end base 104B doe to the tapering at angle, α, of the four sides of each of the frusta 103A, B, 106A, B away from its proximal base 104A.

If present, end frusta 102A is positioned on one of the narrow ends, L, of the central core 101, with a longitudinal central axis coincident with the longitudinal central axis of the central come 101. End frusta 102A may have a similar cross section to the side frusta 103A, 103B such that end frustum 102A has a rectangular flat bottom surface coincident with the bottom surface 202 of the central core 101. This geometry facilitates wedging between neighboring armor units 100, such that the armor unit 100 is symmetric about a vertical plane extending through the centroid parallel to the central elongate axis of the central core 101 and such that the armor unit 100 is symmetric about a vertical plane extending through the centroid and perpendicular to the central elongate axis. In select embodiments of the present invention the side and end formations 103A,B, 102A are equal in height, d (FIG. 1) and the extrusions 106A, B are <d.

Note that setting the thickness of the central care 101 equal to the width (thickness and width defining the dimensions of the ends of the central core 101) creates a square bases for the end frusta 103A, if present, and if the length of the central core 101 is equal to twice its width, the frusta 102A, 103A, B may be of the same shape at the base. If the angle of slope, α (FIG. 1) is held constant for all two (or three if 102A is present) faces of each frusta 102A (if present), 103A, B, the frusta 102A, B, 103A, B are the same shape overall. Finally, if the height, d, of each of the frusta 102A, 103A, B is also identical, all frusta 102A, 103A, B are identical having square bases and distal bases 104B that are square.

Figure 3:
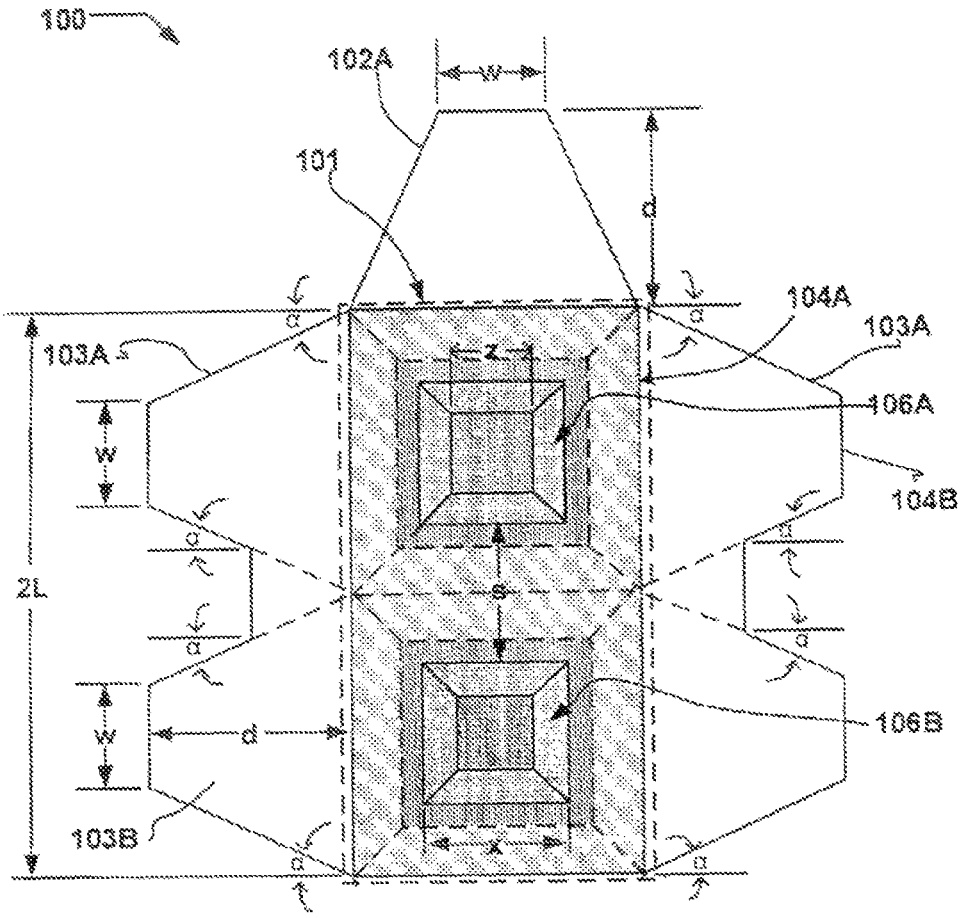
FIG. 3 is a view looking at the bottom of a select embodiment of the present invention having only one end frusta.
Figure 4:
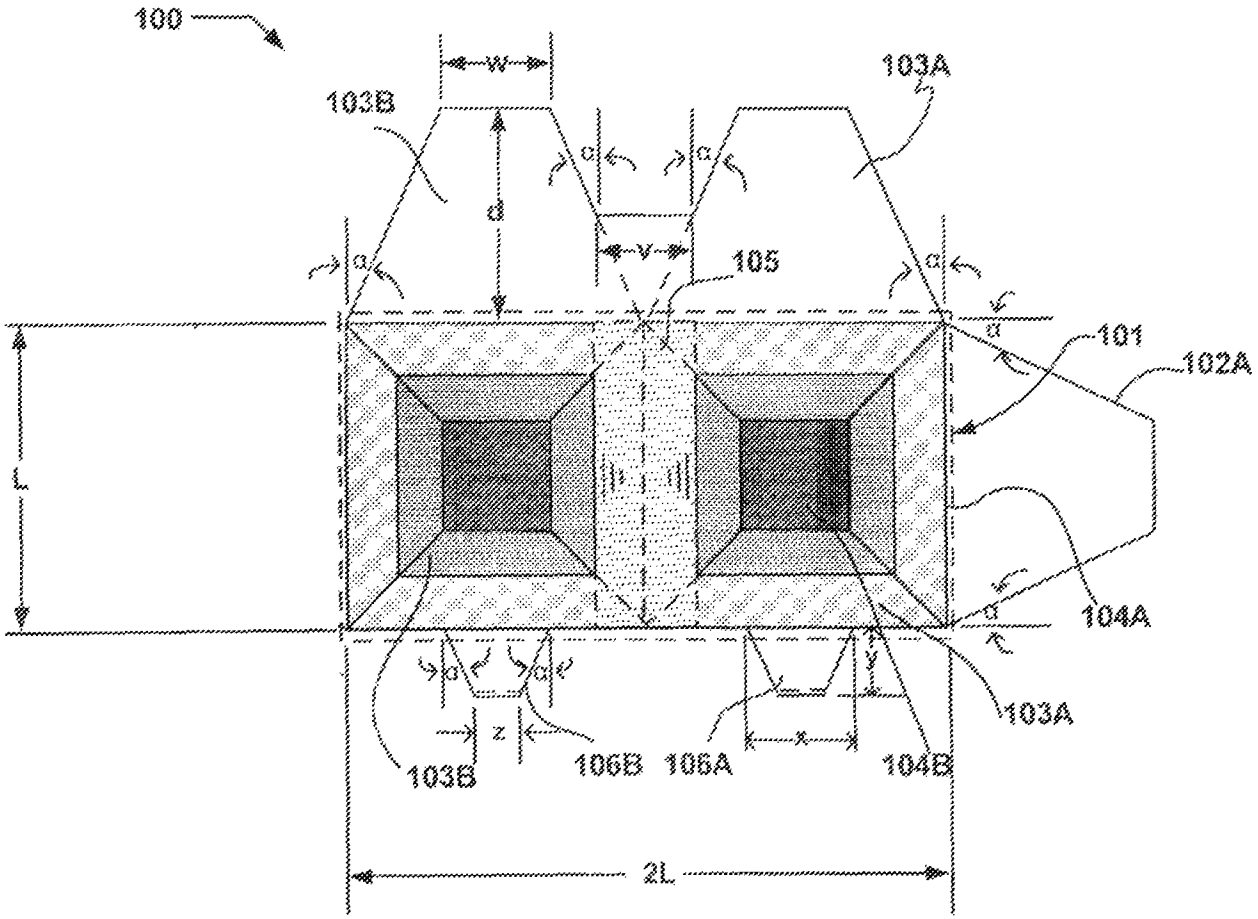
FIG. 4 is a view looking at the longest side of a select embodiment of present invention having only one end frusta.
Figure 5:
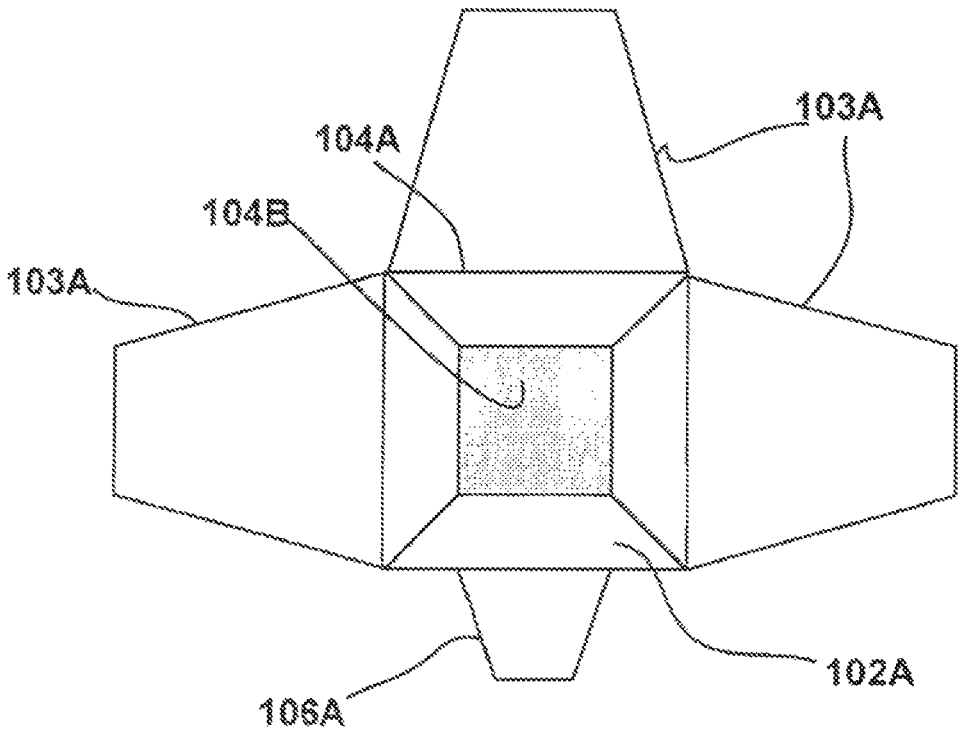
FIG. 5 is a head-on end view of a select embodiment of the present invention having only one end frusta, looking down the longest axis and facing the one end having the frusta.
Figure 6:
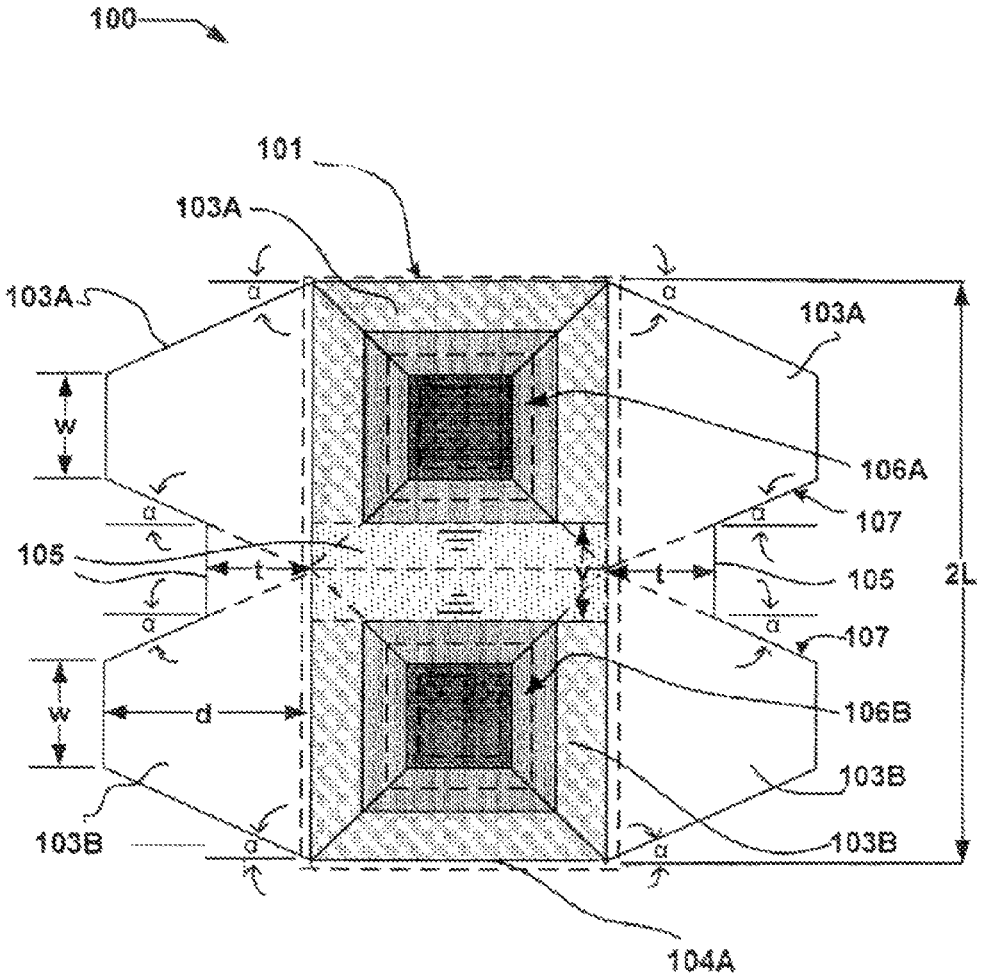
FIG. 6 is a top view of a select embodiment of the present invention having no end frusta.
Figure 7A:
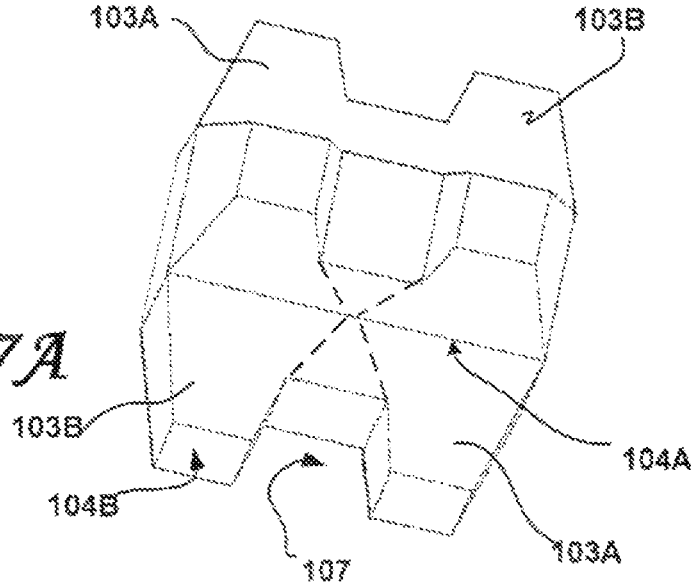
FIG. 7A is a perspective view from the top of a select embodiment of the present invention having no end frusta.
Figure 7B:
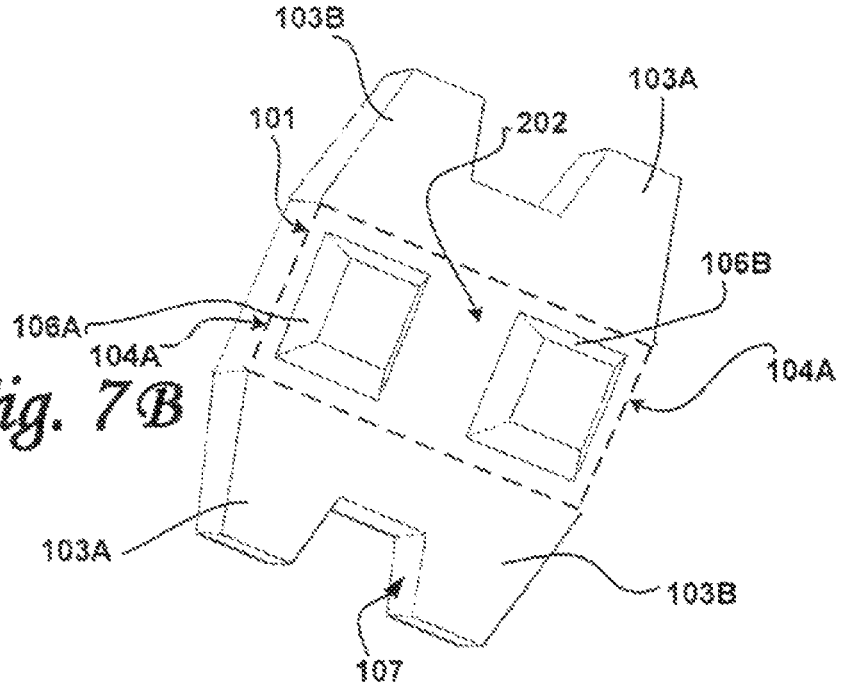
FIG. 7B is a perspective view from the bottom of a select embodiment of the present invention having no end frusta.
Figure 8:
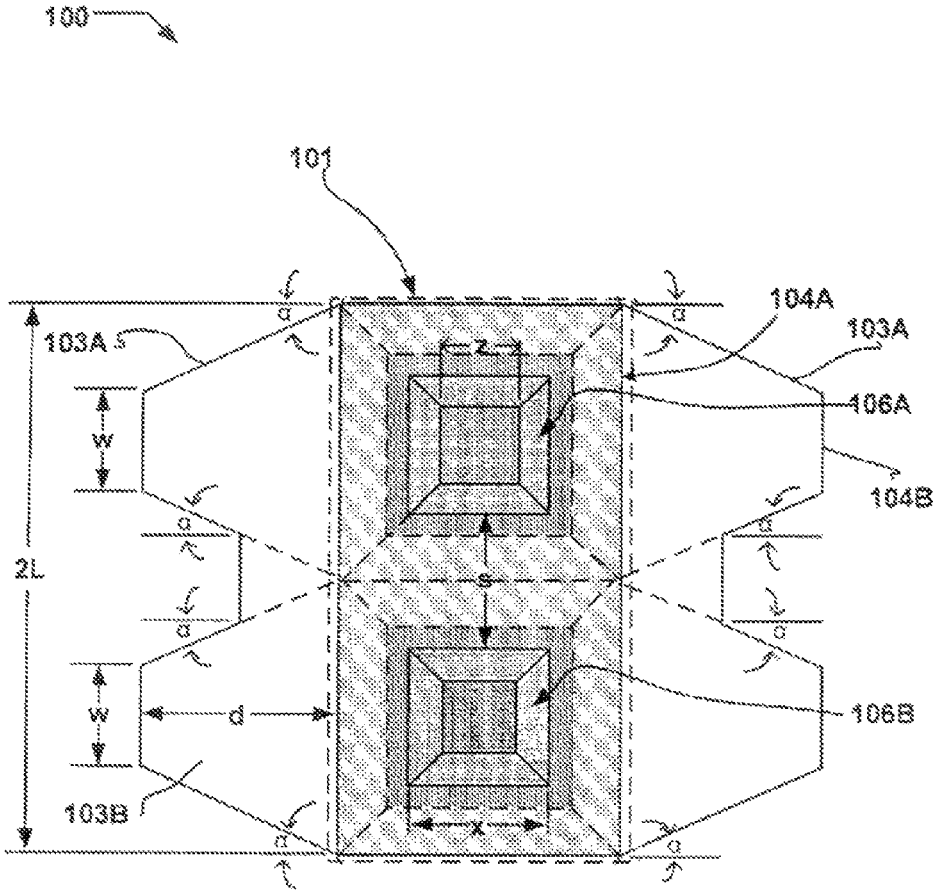
FIG. 8 is a view looking at the bottom of embodiment of the present invention having no end frusta.
Figure 9:
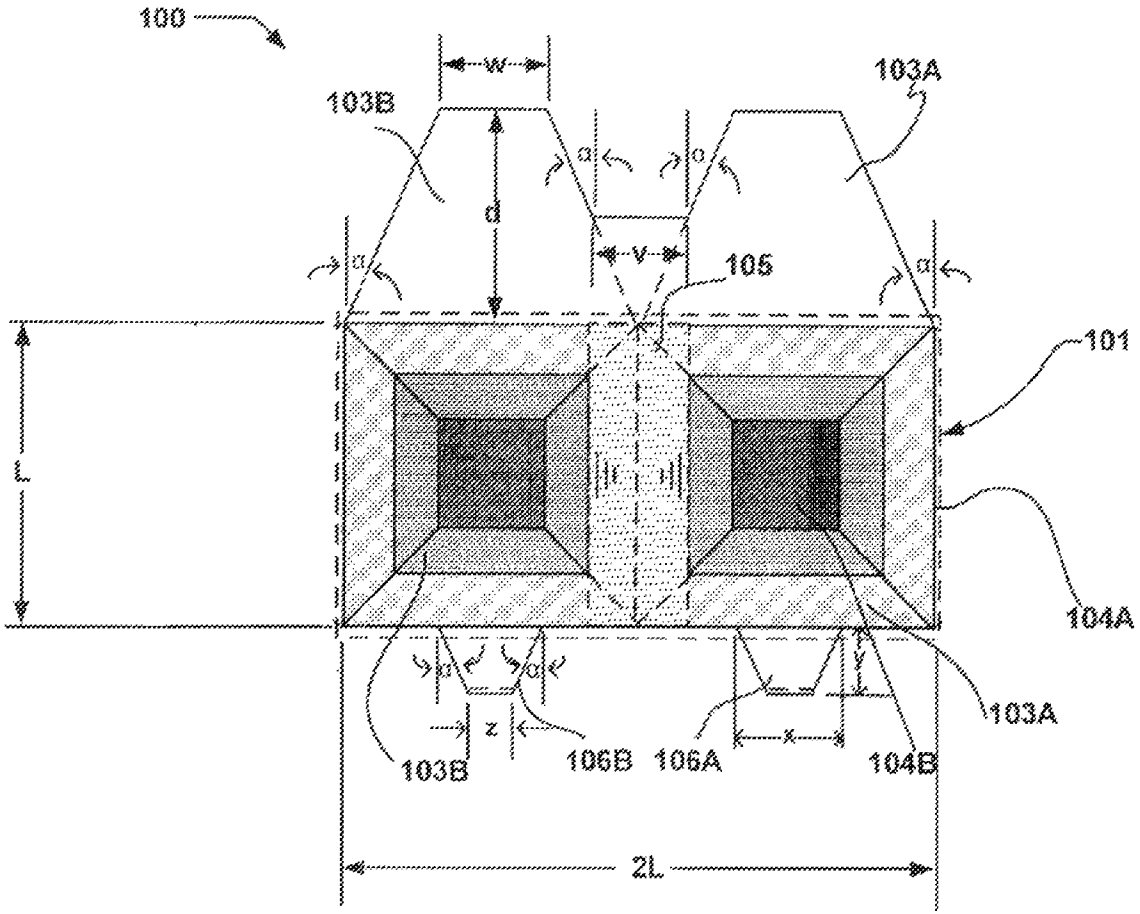
FIG. 9 is a view looking at the longest side of a select embodiment of the present invention having no end frusta.

Select embodiments of the present invention provide armor units 100 as the fundamental component for protecting ocean, coastal, river, lake and reservoir banks, and base structure layers from the damaging hydrodynamic forces of waves and water currents. Refer to FIG. 1. In select embodiments of the present invention, an armor unit includes a central core 101 having a length, 2L, longer than its width, L, and a depth equal to (see L at FIG. 4) or shorter than its width, L. Each of two of the long sides and the top of the central core 101 include two outer members 103A, B that are frusta whose four-sided bases are each defined by one-half of the perimeter of the long side of the central core 101 and a line bisecting the longitudinal axis of the central core 101. In select embodiments of the present invention, a fillet 105 in the center of each of the two long sides and the top effectively shortens the "internal" (facing) side 107 of each of the frusta 103A, B. Optionally, on one of the two ends (short sides) of the central core 101 is a single frusta 102A whose four-sided base is defined by the width and depth of the central core section 101. Width, L, and depth, L, are shown as equal if FIGS. 3 and 4 are taken to be of the same armor unit 100, but need not be. The remaining long side (bottom) 202 in FIG. 2B has two frusta 106A, B incorporated as "supports" and thus this fourth long side defines the bottom surface 202 of the armor unit 100, established for ease of fabrication of the armor unit 100 as well as for the utility of it. These supports 106A, B may be frusta of the same general shape as that of frusta of the other three sides 103A, B, of the end frusta 102A (if present), or both, and may be centered in the same location on the bottom 202 as those frusta 103A, B on the opposing (top) side, in select embodiments of the present invention, the four-sided base of these two supports (frusta) 106A, B has a smaller perimeter and the height, d, of the two frusta 106A, B is shorter than those of the frusta 103A, B on the other two long sides. This design promotes as high degree of wedging while providing many paths for wave dissipation over the surfaces of the appendages 102A, 103A, B, 106A, B of the armor unit 100.

Select embodiments of the present invention may incorporate internal reinforcing bars or "rebar." A suitable reinforcement may be that described in U.S. patent application Ser. No. 11/234,184, to Day et al., incorporated herein by reference. Select embodiments of the present invention were developed to provide optimized armor units 100 for situations when conditions are not ideal for casting or placing concrete armor units 100, or both. Select embodiments of the present invention are designed to be stout, simple to cast, and easy to place in adverse conditions on a breakwater, revetment, or jetty. Refer to FIG. 2A, FIG. 2B, FIG. 7A and FIG. 7B.

For select embodiments of the present invention, the molds are less expensive to fabricate then conventional armor units because the number of plates is less. Further, since all plates are flat the mold is relatively easy and inexpensive to construct.

In commonly-assigned U.S. Pat. No. 8,132,985, it is a considerable accomplishment that select embodiments of the armor unit therein have only 33 flat plates in their primary configuration. It is stated therein that it "is one of the lowest plate numbers of known complex-shaped interlocking armor units."

Quite surprisingly, this low mold plate number can be lowered on the order of 4 plates for an embodiment of the invention wherein one end frusta 102A is present. In embodiments of the invention where no end frusta are present, this low mold plate number can be lowered on the order of 8 plates.

Dramatic reductions in mold cost, labor cost, unit cost of the concrete are all achieved while armor unit performance criteria are not compromised, and unexpectedly, armor unit performance is excellent despite the removal of one or both end frusta from the design of U.S. Pat. No. 8,132,985. In embodiments of the invention the volume of concrete may be reduced at least 5% when one end frustum is removed, and in further embodiments of the invention the volume of concrete may be reduced at least 10% when both end frusta are removed. In other embodiments of the invention the volume of concrete may be reduced at least 7.5% when one end frustum is removed, and in further embodiments of the invention the volume of concrete may be reduced at least 15% when both end frusta are removed.

Specifically, there is a simplification of the manufacturing process of the armor units in accordance with the invention which consists of several factors. First, as mentioned above, there are either four (one less frustum) or eight plates less (two less frusta) than the approximately 33 plates required for the armor unit as described in commonly-assigned U.S. Pat. No. 8,132,985. In addition, in embodiments of the invention, there is more consistency of the concrete in the cast armor units in accordance with the invention because of the simplified nature of the casting process due to the reduction of plates used, the reduced number of frusta used and a reduced amount of concrete used when manufacturing the armor units of invention. Furthermore the curing of the concrete in the forms is simplified because there is at least one less, or in other embodiments at least two less, frusta. Moreover, the cost of producing and constructing the less complex forms (having fewer plates) is reduced.

The benefits of the armor unit in accordance with the invention are not limited to the above-described manufacturing improvements and cost reductions. When comparing the armor unit in accordance with the invention to the armor unit as described in commonly-assigned U.S. Pat. No. 8,132,985, a quantitative approach can be taken. Because both units are scalable (e.g., the dimension L or 2L in the Figures can vary for any given installation or project) the comparison is made between units having the same core dimensions and frusta dimensions, and therefore an identical cross-sectional area of the centroid which is expressed in square meters. This area is placed in the denominator. The volume of the unit in cubic meters is placed in the numerator.

This variable, which can be called a "volume efficiency factor" and having units of meters, can be used as an expression of the improvement of the armor units of the invention wherein they have a lesser amount of concrete per armor unit when compared to the armor unit as described in commonly-assigned U.S. Pat. No. 8,132,985 having the same cross-sectional area.

When the volume efficiency factor for the armor units in accordance with the invention is compared to the volume efficiency factor for the armor unit as described in commonly-assigned U.S. Pat. No. 8,132,985 having the same cross-sectional area, the difference can be expressed as a percentage and represents the improvement of the armor units in accordance with the invention via the reduced amount of concrete volume per given unit. This improvement (the reduction in concrete volume) given particular cross-sectional area as expressed by the volume efficiency factor may be least 5%, may be at least 10%, may be at least 20%, or furthermore may be at least 30%.

Another important aspect of the improvements of the armor unit in accordance with the invention is that they may be obtained while also obtaining consistent performance, or improved performance, in such important performance criteria as packing density and/or hydraulic stability.

Packing density of an armor unit on a slope or grid is defined as (#units)/(unit area of slope), so it refers to as larger area of several units.

Typically for both armor units in accordance with the invention as well as the armor unit as described in commonly-assigned U.S. Pat. No. 8,132,985, the packing density may be in the range of 0.65 to 0.75.

So, in embodiments of the present invention, the volume efficiency factor is improved for installations of the armor unit in accordance with the invention when compared to armor units as described in commonly-assigned U.S. Pat. No. 8,132,985, when both have a similar packing density in the range specified above.

Placement of the completed armor units in the water at the project site is a highly complex process involving, at times, divers, crane operators, GPS devices, water visibility, currents, waves, slope conditions and other variables. Although the armor units in accordance with commonly-assigned U.S. Pat. No. 8,132,985 represent advancement in the art in respect of ease of placement, the armor units in accordance with the invention are even easier to place than the armor units in accordance with commonly-assigned U.S. Pat. No. 8,132,985.

At least one reason for this is that they have either one of the frusta removed or both of the frusta removed. Accordingly, when they are being lowered into place on the slope or grid, there is no "pointed" end of the armor unit to engage the surface of the slope or grid upon which the armor unit is to be placed. Therefore, any rocking, pivoting or shifting that may happen when the armor unit as described in commonly-assigned U.S. Pat. No. 8,132,985 is lowered and placed is either reduced or eliminated. As a consequence, the complex placement process is simplified, the packing densities of the completed placements are more predictable and precise, and those packing densities may be achieved with more accuracy.

In select embodiments of the present invention the armor unit 100 comprises in large part portland cement-based concrete.

For select embodiments of the present invention, the uniform tapering of the side frusta 103A, B at angle, $\alpha$, facilitates wedging of adjacent armor units 100 when placed in a layer on a rubble mound. The uniform taper also aids in removal of the mold during fabrication. For select embodiments of the present invention the flat bottom surface 202 facilitates casting and the added extrusions 106A, B insure bottom surface roughness and interlocking when the armor unit 100 is installed.

The abstract of the disclosure is provided to comply with the roles requiring an abstract that will allow a searcher to quickly ascertain the subject matter of the technical disclosure of any patent issued from this disclosure. 37 CFR §1.72(d). Any advantages and benefits described may not apply to all embodiments of the invention.

While the invention has been described in terms of some of its embodiments, those skilled in the art will recognize that the invention can be practiced with modifications within the spirit and scope of the appended claims. For example, although the system is described in specific examples for providing a suitable armor unit having symmetry on at least three sides, other alternatives are possible, to include selection of different slope angles, $\alpha$, for one or more sides, different heights, d, for one or more sides, a different number and type of extrusions 106A, B, and the like. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Thus, it is intended that all matter contained in the foregoing description or shown in the accompanying drawings shall be interpreted as illustrative rather than limiting, and the invention should be defined only in accordance with the following claims and their equivalents.

We claim:

1. An armor unit, comprising: a rectangular central core of length longer than width and the width at least as long as depth and having two opposed ends; said ends of said central core defined by said width and said depth; three identical pairs of frusta of a first specified height, each said pair joined by a fillet established as an inverted triangle, a tip of which triangle abuts at a location where a proximal base of each said frustum ire said pair abuts, a first and second of said pairs located on first and second opposing sides of said central core, respectively, said first and second opposing sides parallel one to the other as established by said length and said depth, a third of said pairs located on a third side established by said length and said width, said third side identified as the top of said central core, said third side perpendicular to said first and second sides, wherein internal stress levels are minimized by adding said fillets; and two identical bottom frusta that protrude from a fourth side of said central core.

* * * * *